United States Patent [19]

Kirma

[11] Patent Number: 4,564,255

[45] Date of Patent: Jan. 14, 1986

[54] STRAIN RELIEF DEVICE FOR AN ELECTRICAL PLUG CONNECTOR

[75] Inventor: Safa Kirma, Hamburg-Wedel, Fed. Rep. of Germany

[73] Assignee: Messerschmitt-Boelkow-Blohm Gesellschaft mit beschraenkter Haftung, Munich, Fed. Rep. of Germany

[21] Appl. No.: 602,930

[22] Filed: Apr. 23, 1984

[30] Foreign Application Priority Data

May 19, 1983 [DE] Fed. Rep. of Germany ..... 3318248

[51] Int. Cl.[4] ..... H01R 13/58

[52] U.S. Cl. ..... 339/103 R; 339/103 M

[58] Field of Search ..... 339/103 R, 103 M, 103 B, 339/103 C

[56] References Cited

U.S. PATENT DOCUMENTS

| | | | |
|---|---|---|---|
| 3,675,184 | 7/1972 | Vetter | 339/103 B |
| 3,720,906 | 3/1973 | Punako et al. | 339/103 R |
| 3,732,527 | 5/1973 | McKnight | 339/103 M |
| 4,362,349 | 12/1982 | Gallusser et al. | 339/89 M |

FOREIGN PATENT DOCUMENTS

| | | | |
|---|---|---|---|
| 1268537 | 3/1972 | United Kingdom | 339/103 R |

OTHER PUBLICATIONS

"Qwik-Ty Strain Reliefs", Glenair, Inc., 1980.

IBM Technical Disclosure Bulletin, vol. 3, No. 6, 11/1980, "Double Angle Strain Relief Clamp", Uberbacher.

NSA 938154-pp. 1, 2, & 3.

*Primary Examiner*—John McQuade

*Attorney, Agent, or Firm*—W. G. Fasse; D. H. Kane

[57] ABSTRACT

A strain relief device for a multipole electrical plug connector, is constructed for holding a bunch of conductors either axially or at a right angle to its main axis. The device is also simplified in its structure so that the manufacture of its components and their assembly is facilitated. The device has a cap nut with a radially inwardly extending flange, and a housing with a radially outwardly facing circumferential channel. The housing has a through slot in its wall for temporarily and elastically compressing the housing radially inwardly so that the channel may engage the flange of the cap nut which is then locked in place, but rotatable relative to the housing. The flange either directly or indirectly helps compressing a sealing member in the connector proper. A conductor bundle holder includes a bail which can be secured to the housing in several different positions for holding a bundle of conductors either to extend axially or at an angle out of the housing.

9 Claims, 6 Drawing Figures

FIG. 3
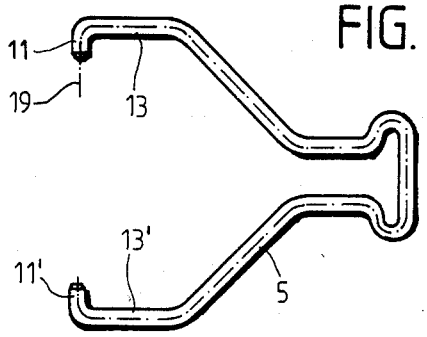
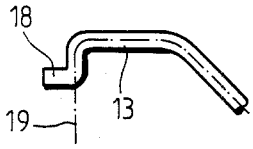
FIG. 4
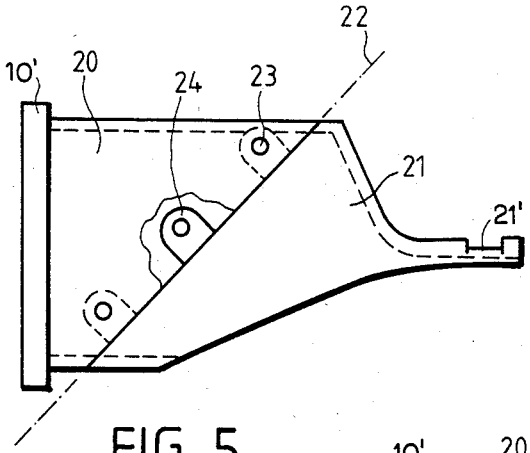
FIG. 5
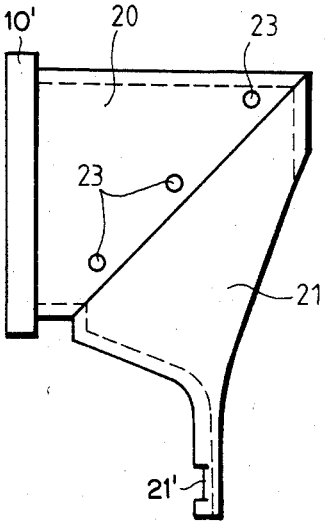
FIG. 6

STRAIN RELIEF DEVICE FOR AN ELECTRICAL PLUG CONNECTOR

FIELD OF THE INVENTION

Ths invention relates to a strain relief having a housing to be fixed, with one of its ends, to a multiple electrical connector, especially a round connector, which, at its other end is adapted to hold a bundle of electrical conductors extending out of the connector.

BACKGROUND OF THE INVENTION

Strain relief devices for multipole electrical plug connectors are known in the art. The plug terminals may be contact pins in a male type connector plug or they may be connector bushings in a female type connector plug. The housing of the relief device is provided with a cap nut for securing the device to a respective connector plug. For this purpose the cap nut has an internal threading and the connector plug has an external threading cooperating with the internal threading. The cap nut also functions for compressing a sealing ring operatively inserted between the housing of the relief device and the connector plug. The purpose of such a sealing ring which is not part of the invention is to seal each conductor of a cable or conductor bundle connected to the connector plug against moisture and other contaminations by blocking a path for the moisture into the connector plug. Depending on the installation requirements, the housing of the relief device may have a straight shape, whereby the conductor bundle extends away from the connector plug substantially coaxially with a central axis of the connector plug. In an alternative embodiment the housing of the relief device may have an angular shape, whereby the conductor bundle extends substantially at a right angle to the central axis of the connector plug. Additionally, such connector plugs are equipped with conductor bundle holding means which are supposed to protect the conductors of a bundle against tensile stress. Relief device housings for such connectors are described, for example, in standard sheet NSA No. 938 154, whereby the additional designating number 01 refers to a straight housing, while the additional designating number 02 refers to an angular housing.

Conventional relief device housings with their cap nuts have particularly the following disadvantages. In most instances it is necessary to disconnect the individual conductors from the terminal pins or terminals bushings where it is required to remove the housing from a conductor bunch or bundle. Thereafter, when the cable bunch or bundle is to be reconnected, each individual conductor requires an individual reconnection to its pin or bushing. Further, if the plug is to be used without a relief device housing the plug requires a different kind of cap nut for assuring a good sealing function even without a relief device housing. Besides, a different housing is required for a straight installation in which the conductor bunch extends substantially parallel to the central axis of the plug, than in an angled installation in which the connector bunch or bundle extends substantially at a right angle relative to the central axis of the connector plug.

OBJECTS OF THE INVENTION

In view of the above it is the aim of the invention to achieve the following objects singly or in combination:

to construct a relief device of the type described above in such a manner that after its mounting it is not necessary to disconnect the individual conductors and hence not necessary to reconnect these individual conductors where it is desired to remove the housing of the relief device;

to construct the relief device housing in such a manner that the same cap nut can be used for different types of installations such as a straight installation or an angled installation;

to construct the relief device housing so that connector bundle holding means may extend substantially coaxially or in at least one, preferably two, substantially rectangular directions relative to a central housing axis which is also the central axis of the respective connector plug; and to construct the relief device housing in such a manner that a straight housing or an angular housing may be assembled from the same housing components.

SUMMARY OF THE INVENTION

A strain relief device for multipole electrical connector plug, especially a round connector plug, has a housing adapted for connection to a conductor bundle holding member and comprises according to the invention, a cap nut having an inwardly directed flange, preferably adjacent to its end facing a connector bundle. Such flange is provided with an axially facing flange surface adapted for compressing either directly or indirectly a sealing member such as a sealing ring. The cap nut provides a sufficient axially extending play space into which a respectively shaped flange member of the relief device housing reaches for compressing said sealing member. Further, the conductor bundle holding member is so constructed that it may be operatively secured to the housing for holding a conductor bundle against tensile stress in one of several positions relative to the central axis, especially in a coaxial position or in an angular position relative to the central axis of the connector plug.

BRIEF FIGURE DESCRIPTION

In order that the invention may be clearly understood, it will now be described, by way of example, with reference to the accompanying drawings, wherein;

FIG. 3 shows the conductor bundle housing member in the form of a wire bail;

FIG. 4 shows a detail of the bail of FIG. 3;

FIG. 5 illustrates a side view of a tubular housing member having an angularly cut end for cooperation with an also angularly cut tubular conductor bundle holding member arranged so as to hold the conductor bundle in an axially oriented position;

FIG. 6 illustrates the housing of FIG. 5 with the tubular conductor bundle holding member secured to the housing so as to hold a conductor bundle in an angularly oriented position.

Figure 1:
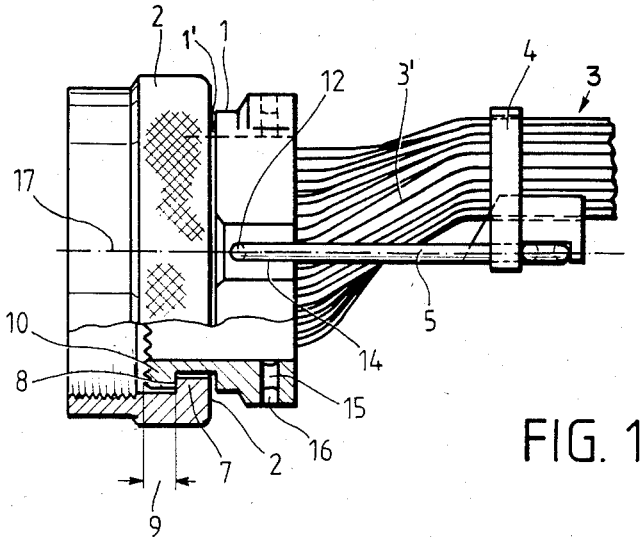
FIG. 1 shows a side view of a strain relief device according to the invention, partially in section, and with a conductor bundle extending substantially coaxially or in parallel to a central axis of a connector plug inside the housing of the strain relief device.

DETAILED DESCRIPTION OF PREFERRED EXAMPLE EMBODIMENTS AND OF THE BEST MODE OF THE INVENTION:

FIG. 1 illustrates a strain relief device for an electrical connector plug according to the invention having a housing 1, also referred to as an end housing in the form of a ring, and a cap nut 2 secured to the housing 1 and shown partially in section at the lower half of FIG. 1. A bundle 3 of conductors 3' is secured to the connector plug proper inside the housing 1 in a conventional manner. The connector plug itself is not shown since it is not part of the invention. The strain relief device for the conductor bundle comprises a wire bail 5 equipped with a strap 4 securing the bundle 3 to the wire bail 5. The wire bail 5 will be described in more detail below with reference to FIGS. 3 and 4.

Figure 2:
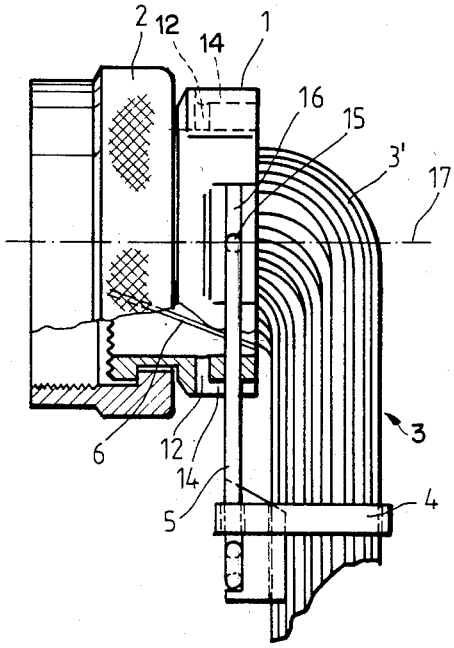
FIG. 2 is a view similar to that shown in FIG. 1, however, illustrating the conductor bundle in an angular position relative to the central connector plug or housing axis.

FIG. 2 shows that the housing 1 comprises a slot 6 in its circumferential wall which permits an elastical deformation of the housing 1 radially inwardly for mounting the cap nut 2 or for removing the housing 1 from the cap nut 2 by radially compressing the housing 1 to thereby permit the shoulder 10 of the housing 1 to clear a radially inwardly directed flange 7 of the cap nut 2. In the mounted position the flange 7 reaches into a channel 1' running circumferentially around the housing 1 and facing radially outwardly. This construction of the housing 1 with the slot 6 makes it possible to first remove the cap nut 2 by squeezing the housing 1 inwardly and then slightly expanding the housing 1 outwardly for removing the housing 1 from the connector plug (not shown) without disassembling the entire conductor bundle 3 except for removing the bail 5. The flange 7 has an axially facing surface or shoulder 8, which bears against the shoulder 10 of the housing 1, whereby the shoulder 10 under the pressure applied through the cap nut 2 compresses a sealing cushion not shown but resting against the shoulder 10. By compressing such a sealing ring when the cap nut 2 is connected to a socket not shown, the individual conductors 3' are sealed against moisture and other contaminations. If the connector plug is to be used without a conductor bundle holding member 5, then it is not necessary to use the housing 1 and in that instance the axially facing surface or shoulder 8 would directly contact a sealing ring not shown. For this purpose the cap nut 2 is provided with a play space 9 free of the internal threading.

FIG. 3 shows the wire bail 5 with two prongs 13 and 13'. Each free end of the two prongs has a snap-in member 11 and 11' extending at right angles to adjacent straight prong sections. The snap-in members 11, 11' are biased toward each other due to the particular shape of the wire bail 5 so that these snap-in members 11, 11' may engage holes 12 in the housing 1 which is also provided with axially extending grooves 14, two of which are located on opposite sides of the housing 1 so that the straight portions of the prongs 13, 13' may engage into these grooves for arresting the bail in the position shown in FIG. 1 to thereby hold the conductor bundle 3 to extend substantially in parallel to the central axis 17 of the connector plug.

FIG. 2 shows the arrangement of the wire bail 5 so that its snap-in members 11, 11' extend into holes 15, two of which are also located on opposite sides of the housing 1 so that the holes 12 and 15 are spaced at right angles from each other. In this position shown in FIG. 2 the bail 5 extends substantially at right angles to the central axis 17 and the strap 4 holds the conductor bundle 3 also in this angled position because the straight portions of the prongs 13, 13' engage in grooves 16 which extend across the central axis 17. Again, two grooves 16 are provided on opposite sides of the housing 1. Preferably, the grooves 16 extend all the way across the central axis 17 so that the wire bail 5 may extend in the direction shown in FIG. 2 or in the opposite direction.

FIG. 4 shows an anchoring portion 18 extending substantially at a right angle to the journal axis 19 of the snap-in members 11, 11'. The bending of the anchoring portion 18 may take place while assembling the wire bail with the housing 1 which for this purpose is provided with a respective recess into which the anchoring portion 18 may grip in manner somewhat similar to a bayonet type connection. This may be accomplished by initially providing the snap-in members 11, 11' with a sufficient length for bending the anchoring portion 18 with the aid of a respective tool when inserting the snap-in members 11, 11' into the housing 1. In order to assure a small bending radius between the anchoring portion 18 and the remaining snap-in portion 11, 11', it is possible to provide the wire with a reduced diameter at the location where the bending is supposed to take place.

FIGS. 5 and 6 show a second embodiment of the invention comprising a tubular housing 20 and a tubular conductor bundle holding member 21, both cut at a miter angle along the line 22 extending in the manner of a miter relative to the central axis of the connector plug, whereby the same bundle holding member 21 can take up the position shown in FIG. 5 or the position shown in FIG. 6.

In FIG. 5 the conductor bundle holder 21 is so secured to the tubular housing member 20 that the conductor bundle 3 will extend substantially in parallel to the longitudinal connector plug axis. A connecting strap not shown will be secured in the groove 21'. The housing member 20 or the connector bundle holder 21 are provided with lugs 24 having pins 23 engaging into respective holes in the other member, whereby the two components are interconnected with a snap fit. Further, the tubular housing member 20 is provided with a flange 10' which performs the same function as the flange or shoulder 10 described above.

As shown in FIG. 6 disconnecting the tubular bundle holder 21 from its position shown in FIG. 5 and reconnecting it into a position as shown in FIG. 6, the bundle 3 will extend at an angle relative to the central longitudinal axis of the connector plug.

The housing 1 and the cap nut 2 as well as the housing member 20 and the bundle holder 21 are made of conventional materials and these materials are selected with due regard to the required characteristics and with due regard to their costs. Thus, these components may be made to a substantial extent of synthetic plastic materials.

Although the mounting of the housing 1 to the cap nut 2 has been described with reference to the slot 6, it will be appreciated, that different ways could be employed for interconnecting these two components in an axially fixed, yet relative rotatable manner.

Although the invention has been described with reference to specific example embodiments, it will be appreciated, that it is intended to cover all modifications and equivalents within the scope of the appended claims.

What is claimed is:

1. A strain relief device for a bundle of conductors, comprising a housing having a central axis, a cap nut having a radially inwardly extending flange with an axially facing flange surface, said housing comprising means for securing said cap nut to said housing in an axially substantially fixed manner but permitting a relative rotation between said cap nut and said housing about said central axis, conductor bundle holding means operatively secured to said housing for holding a conductor bundle against tensile stress in one of several positions relative to said central axis, said conductor bundle holding means comprising a wire bail having two prongs each with a free prong end forming a snap-in member, each prong further including a substantially straight prong section adjacent to each snap-in member, said housing having holes receiving said snap-in members for journalling said wire bail into one of several positions relative to said central axis, said housing further having grooves therein for arresting said substantially straight prong sections in any one of said several positions.

2. The strain relief device of claim 1, wherein said grooves in said housing comprise at least one groove which extends in parallel to said central axis for holding a conductor bundle to extend substantially parallel with said central axis, and a further groove extending at an angle relative to said central axis for holding a conductor bundle to extend substantially at said angle.

3. The strain relief device of claim 1, wherein said grooves in said housing comprise two pairs of grooves, each pair of grooves having two grooves located opposite each other in said housing, one pair of grooves extending substantially in parallel to said central axis for holding a conductor bundle to extend substantially parallel with said central axis, the other pair of grooves extending at an angle relative to said central axis for holding a conductor bundle to extend substantially at said angle.

4. The strain relief device of claim 3, wherein said two grooves of said other pair of grooves extend across said central axis for angling a conductor bundle substantially at a right angle relative to said central axis in one of two possible directions across said central axis.

5. The strain relief device of claim 1, wherein said snap-in members at each free prong end comprise a bent anchoring portion (18) for anchoring said wire bail in said housing.

6. The strain relief device of claim 1, wherein said means for securing said cap nut said housing comprise a radially outwardly open channel around said housing, said radially inwardly extending flange of said cap nut reaching into said radially outwardly open channel, said housing further comprising slot means (6) therein for snapping said housing onto said radially inwardly extending flange of said cap nut.

7. The strain relief device of claim 6, wherein said slot means comprise one slot (6) extending at an angle through said housing for elastically deforming said housing radially inwardly for snapping said housing onto said radially inwardly extending flange.

8. The strain relief device of claim 1, wherein said conductor bundle holding means comprise a bundle securing strap.

9. A strain relief device for a bundle of conductors, comprising a housing having a central axis, a cap nut having a radially inwardly extending flange with an axially facing flange surface, said housing comprising means for securing said cap nut to said housing in an axially substantially fixed manner but permitting a relative rotation between said cap nut and said housing about said central axis, conductor bundle holding means operatively secured to said housing for holding a conductor bundle against tensile stress in one of several positions relative to said central axis, said housing comprising a first tubular member having an end cut at a miter angle to said central axis, wherein said conductor bundle holding means comprise a second tubular member also having an end cut at the same miter angle for locating said second tubular member relative to said first tubular member in any one of two possible positions, and means for releasably securing said second tubular member to said first tubular member in one or the other of said two possible positions, whereby said second tubular member is the same in both of said two possible positions.

* * * * *